US010546528B2

(12) United States Patent
Huang et al.

(10) Patent No.: US 10,546,528 B2
(45) Date of Patent: Jan. 28, 2020

(54) PIXEL CIRCUIT AND METHOD OF ADJUSTING BRIGHTNESS OF PIXEL CIRCUIT

(71) Applicant: TAIWAN SEMICONDUCTOR MANUFACTURING COMPANY, LTD., Hsinchu (TW)

(72) Inventors: Tsung-Ching Huang, San Jose, CA (US); Chan-Hong Chern, Palo Alto, CA (US); Tao Wen Chung, San Jose, CA (US); Ming-Chieh Huang, San Jose, CA (US); Chih-Chang Lin, San Jose, CA (US)

(73) Assignee: TAIWAN SEMICONDUCTOR MANUFACTURING COMPANY, LTD., Hsinchu (TW)

( * ) Notice: Subject to any disclaimer, the term of this patent is extended or adjusted under 35 U.S.C. 154(b) by 0 days.

(21) Appl. No.: 14/827,115

(22) Filed: Aug. 14, 2015

(65) Prior Publication Data

US 2015/0356917 A1 Dec. 10, 2015

Related U.S. Application Data

(62) Division of application No. 13/539,181, filed on Jun. 29, 2012, now abandoned.

(51) Int. Cl.
*G09G 3/3233* (2016.01)
*G09G 3/34* (2006.01)

(52) U.S. Cl.
CPC ..... *G09G 3/3233* (2013.01); *G09G 3/3406* (2013.01); *G09G 2300/0809* (2013.01);
(Continued)

(58) Field of Classification Search
CPC ..... G09G 2320/043; G09G 2320/045; G09G 3/3233; G09G 3/3208
(Continued)

(56) References Cited

U.S. PATENT DOCUMENTS 8,405,583 B2 * 3/2013 Ebisuno ..... G09G 3/325 345/76
8,553,024 B2 * 10/2013 Tsai ..... G09G 3/3233 345/211
(Continued)

FOREIGN PATENT DOCUMENTS

JP WO 2011125107 A1 * 4/2010 ..... G09G 3/30

OTHER PUBLICATIONS

Huang et al., "A Floating Gate OTFT-Driven AMOLED Pixel Circuit for Variation and Degradation Compensation in Large-Sized Flexible Displays," The 49th SID International Symposium, vol. 1 of 3, pp. 149-152, May 2011.
(Continued)

*Primary Examiner* — Yuzhen Shen
(74) *Attorney, Agent, or Firm* — Hauptman Ham, LLP

(57) ABSTRACT

A current value of a first pixel and/or a current value of a second pixel of a display are adjusted until a value of a current difference is within a predetermined range. The current value of the first pixel corresponds to a brightness level of the first pixel. The current value of the second pixel corresponds to a brightness level of the second pixel. Adjusting the current value of the first pixel involves adjusting a threshold voltage value of a transistor of the first pixel. Adjusting the current value of the second pixel involves adjusting a threshold voltage value of a transistor of the second pixel.

20 Claims, 7 Drawing Sheets

(52) U.S. Cl.
CPC ..... *G09G 2300/0819* (2013.01); *G09G 2300/0842* (2013.01); *G09G 2320/0233* (2013.01); *G09G 2320/0295* (2013.01); *G09G 2320/045* (2013.01); *G09G 2330/028* (2013.01)

(58) Field of Classification Search
USPC ..... 345/76, 82
See application file for complete search history.

(56) References Cited

U.S. PATENT DOCUMENTS 9,305,494 B2 * 4/2016 Shim ..... G09G 3/3233
2005/0067970 A1 * 3/2005 Libsch ..... G09G 3/3233 315/169.3
2006/0256126 A1 * 11/2006 Lin ..... G09G 3/20 345/589
2007/0052647 A1 * 3/2007 Chen ..... G09G 3/3233 345/92
2008/0315759 A1 12/2008 Chung
2010/0039458 A1 * 2/2010 Nathan ..... G09G 3/3233 345/698
2010/0253710 A1 10/2010 Rankov et al.

OTHER PUBLICATIONS

Huang et al., "A Floating Gate OTFT-Driven AMOLED Pixel Circuit for Variation and Degradation Compensation in Large-Sized Flexible Displays," The 18th International Display Workshop, pp. 1643-1643, Dec. 2011.
Huang et al., "A Floating Gate OTFT-Driven AMOLED Pixel Circuit for Variation and Degradation Compensation in Large-Sized Flexible Displays," SID Symposium Digest of Technical Papers, pp. 149-152, May 2011, Downloaded from University of Tokyo website: http://lowpower.iis.u-tokyo-ac.jp/publication_list.html.

* cited by examiner

PIXEL CIRCUIT AND METHOD OF ADJUSTING BRIGHTNESS OF PIXEL CIRCUIT

PRIORITY CLAIM

The present application is a divisional of U.S. application Ser. No. 13/539,181, filed Jun. 29, 2012, which is incorporated herein by reference in its entirety.

FIELD

The present disclosure is related to pixels for display.

BACKGROUND

Active-matrix organic light-emitting diodes (AM-OLEDs) used in displays including flexible displays enrich viewer's experience of digital content. Generally, compared with another display such as thin film transistor liquid crystal (TFT-LCD) displays, an AM-OLED display is thinner, brighter, has a wider viewing angle, and consumes lower power. The AM-OLED, however, is more expensive, requires good pixel uniformity, and is more difficult to manufacture.

Thin film transistors (TFTs) including polycrystal silicon TFT and metal oxide TFT are good candidates in pixel circuits for AM-OLED TFT displays. TFT substrates for the displays, however, are usually made of glass or plastics that normally cannot endure high temperature such as 600° C. for crystalline processes.

A display comprises a lot of pixels arranged in rows and columns. Existing pixel circuits include many TFTs and thus result in a larger pixel size, lower resolution, and higher power consumption.

BRIEF DESCRIPTION OF THE DRAWINGS

The details of one or more embodiments of the disclosure are set forth in the accompanying drawings and the description below. Other features and advantages will be apparent from the description, drawings, and claims.

Like reference symbols in the various drawings indicate like elements.

DETAILED DESCRIPTION

Figure 1:
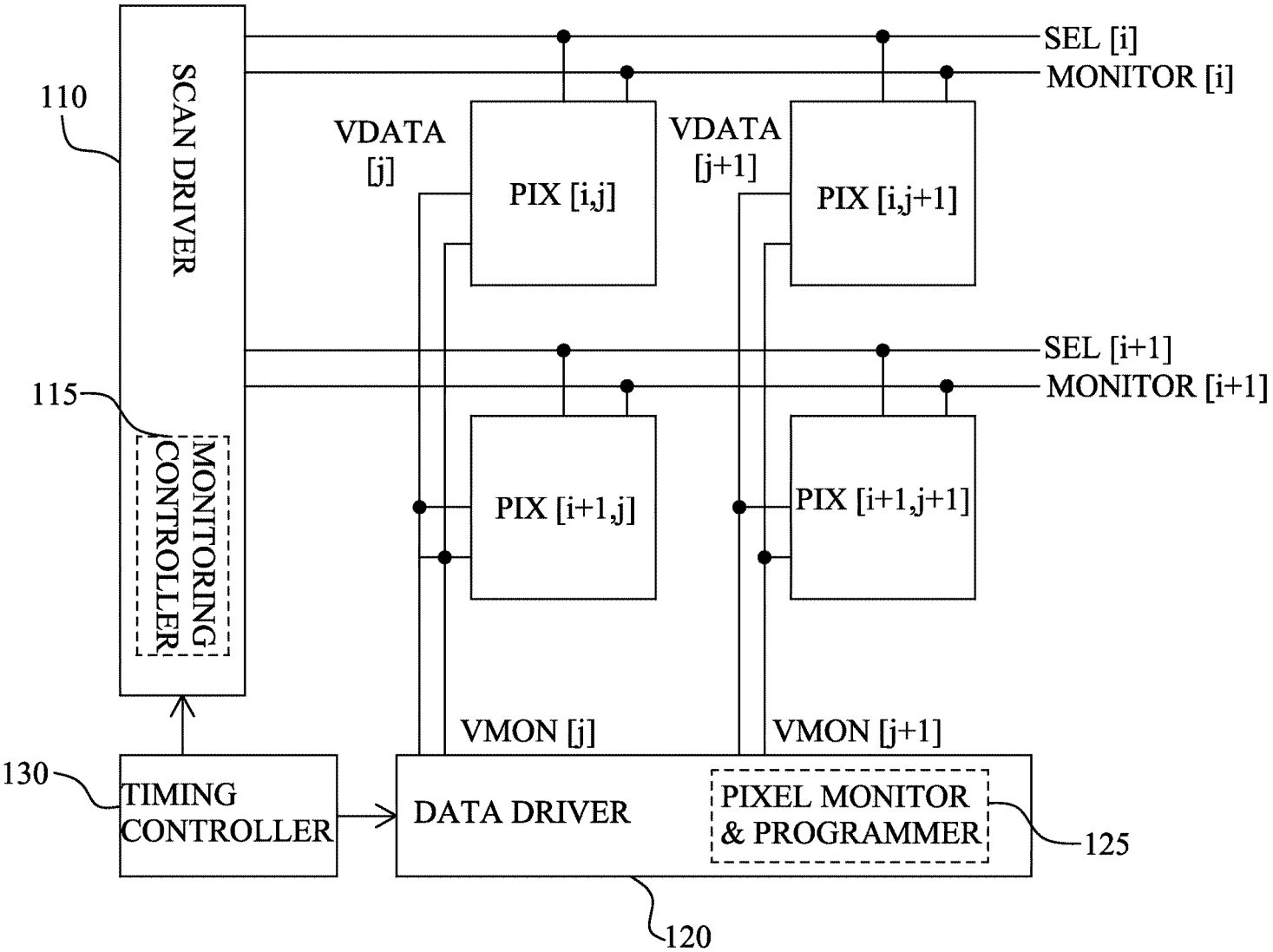
FIG. 1 is a diagram of a pixel array circuit, in accordance with some embodiments.

Embodiments, or examples, illustrated in the drawings are disclosed below using specific language. It will nevertheless be understood that the embodiments and examples are not intended to be limiting. Any alterations and modifications in the disclosed embodiments, and any further applications of the principles disclosed in this document are contemplated as would normally occur to one of ordinary skill in the pertinent art.

Some embodiments have one or a combination of the following features and/or advantages. An electrical current of a thin film transistor (TFT) in a pixel is used to control a brightness of a corresponding LED in the same pixel. A threshold voltage (VTH) of the transistor is adjustable. The current generated by the transistor based on threshold voltage VTH is therefore adjustable. In some embodiments, values of threshold voltage VTH of two transistors in two pixels are adjusted to be closer to one another. Effectively, currents of the two transistors in two pixels are closer to one another. As a result, the brightness of two pixels is closer to one another. In other words, the brightness of two pixels and thus the pixel display is more uniform. Compared with some existing approaches, in various embodiments of the disclosure, a fewer number of transistors is used in a pixel, resulting in a smaller die area for the pixel and a higher resolution for the display. For example, in some embodiments, three transistors with a capacitor are used in a pixel, compared with four transistors and two capacitors being used in another approach. No energy compensation scheme is used, resulting in lower power consumption.

Pixel Array Circuit

FIG. 1 is a diagram of a pixel array circuit 100, in accordance with some embodiments. Pixel array circuit 100 represents a display, and includes a plurality of pixels arranged in rows and columns. For illustration, four pixels are shown. Two pixels are in each row i and row i+1, and two pixels are in each column j and column j+1. Four pixels are therefore identified as pixels PIX [i,j], PIX[i+1, j], PIX[i, j+1], and PIX[i+1, j+1]. In some embodiments, there are about 700-800 pixels PIX in a row and about 768 pixels PIX in a column. Other number of pixels PIX in a row and/or in a column are within the scope of various embodiments.

In some embodiments, a line or row of pixels PIX is turned on line by line. In other words, the display represented by pixel array circuit 100 is scanned line by line. A scan driver 110 turns on and off each line of pixels. When a line is scanned, scan driver 110 provides a logical high to a corresponding signal SEL, which turns on pixels PIX on a line that receive the corresponding signal SEL. For example, when a line i is scanned, scan driver 110 provides a logical high value to signal SEL[i], which turns on pixels PIX on line i that receive signal SEL[i], including pixels pix[i,j] and pixel[i,j+1].

Scanner driver 110 includes a monitoring controller 115 that determines a line of pixels to measure currents and provides corresponding control signals. For example, monitoring controller 115 provides signals MONITOR to turn on monitoring capabilities of pixels PIX. For another example, when signal MONITOR[i] is activated, a transistor TM (shown in FIG. 2.) in line i that receives signal MONITOR[i] is turned on so that a voltage at a terminal of transistor TM is measured. In some embodiments, the scan frequency is 60 Hertz (Hz) in which a line is scanned 60 times a second. Monitoring controller 115 shown in scanner driver 100 is for illustration. Various embodiments of the disclosure are not limited by locations of monitoring controller 115.

A data driver 120 provides video signals VDATA to each pixel PIX being scanned. For example, if pixels PIX[i,j] in row i and column j is scanned, data driver 120 provides signal VDATA[j] to pixel PIX[i,j]. But if pixel PIX[i,j+1] in row i and column j+1 is scanned, data driver 120 provides signal VDATA[j+1] to pixel PIX[i,j+1], etc. Signals VDATA are also used to transfer electrical charges to corresponding pixels PIX. A pixel monitor and programmer 125 of data driver 120 monitors currents from transistors in pixels PIX, and, based on the currents, adjusts or programs a threshold voltage of corresponding transistors. Pixel monitor and programmer 125 shown in data driver 120 is for illustration. Other locations of pixel monitor and programmer 125 are within the scope of various embodiments.

Signals VMON are used to determine various electrical values in corresponding pixels PIX. For example, based on a voltage value of signal VMON[j], current ITD of a transistor TD (shown in FIG. 2) in column j is determined.

A timing controller 130 synchronizes signals provided by scan driver 110 and data driver 120.

Pixel Circuits

Figure 2:
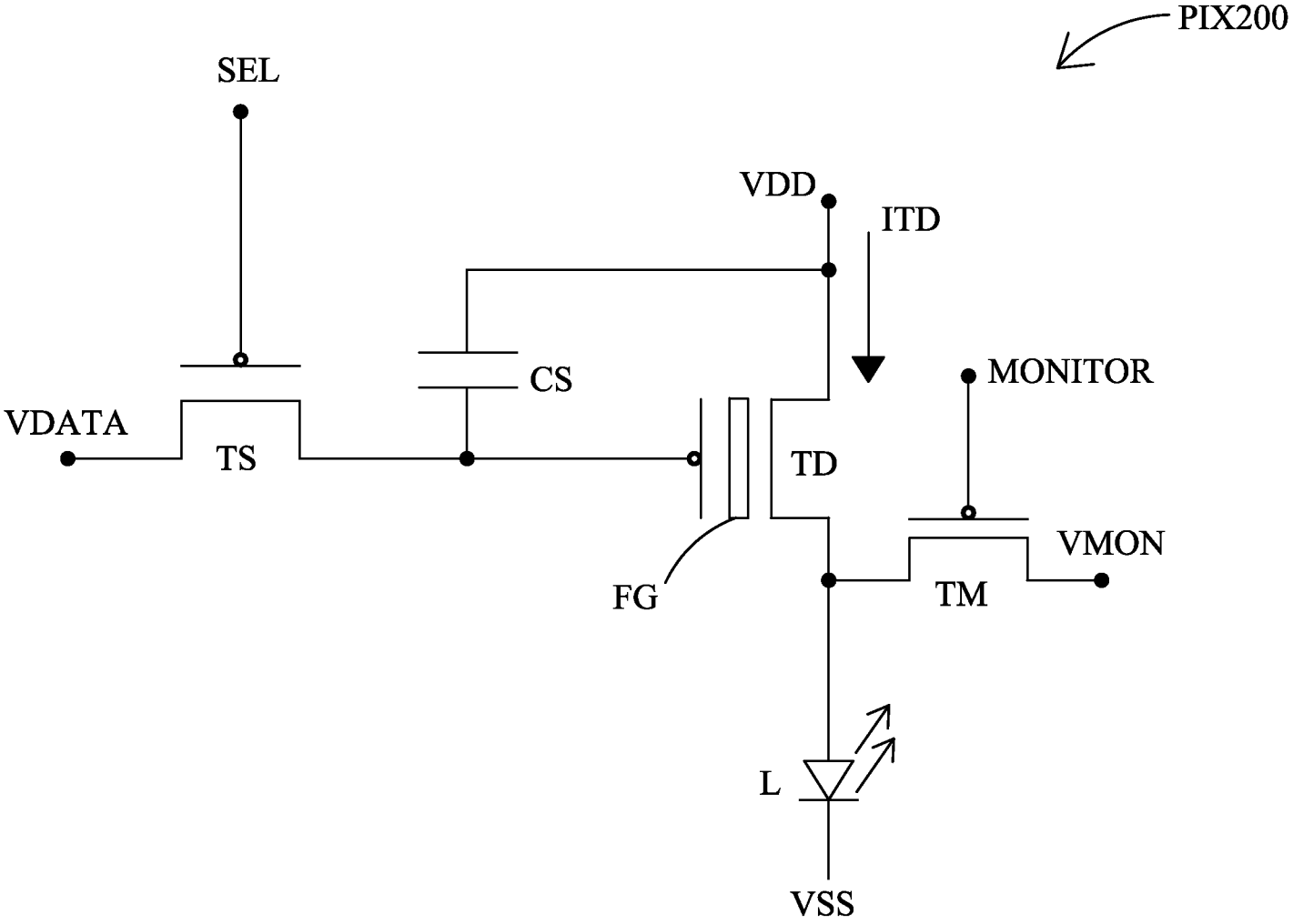
FIG. 2 is a diagram of a pixel circuit or a pixel, in accordance with some embodiments.

FIG. 2 is a diagram of a pixel circuit or a pixel PIX200, in accordance with some embodiments. Pixel PIX200 is an implementation of a pixel PIX in FIG. 1. In some embodiments, an operational voltage value VDD for each of a transistor TM, TD, and TS of pixel PIX200 is about 20 V. Transistors using other operational voltage values are within the scope of various embodiments.

In some embodiments, pixel PIX200 has a red (R), a green (G), and a blue (B) component and therefore three distinct circuitries for three corresponding colors. Each OLED L in pixel PIX200 provides a distinct color based on a brightness of OLED L. The brightness of three OLEDs L with three different colors in pixel PIX200 provides a unique color for pixel PIX200. For illustration, pixel PIX200 is shown having circuits and a corresponding OLED L for one color. Circuits for other colors are similar. Colors other than RGB are within the scope of various embodiments.

A positive terminal of OLED L is coupled with the drain of a PMOS transistor TD while a negative terminal of OLED L receives a reference voltage VSS which, in some embodiments, is ground. Effectively, OLED L serves as a current path for current ITD to flow from PMOS transistor TD to ground. In other words, transistor TD serves as a current source for OLED L while OLED L serves as a current sink for transistor TD. For example, when both transistor TD and OLED are activated, current ITD flows from operational voltage VDD through transistor TD and OLED L to ground.

PMOS transistor TD drives OLED L. For example, transistor TD provides a driving current ITD flowing from a source to a drain of transistor TD and through OLED L to light OLED L. The brightness of OLED L is proportional to an absolute value of current ITD. For example, the higher the absolute value of current ITD, the brighter OLED L is. In contrast, the lower the absolute value of current ITD, the less bright OLED L is.

Transistor TD has a floating gate FG to store electrical charges, and floating gate FG is made of gold (Au) in some embodiments. Other materials for floating gate FG are within the scope of various embodiments. A threshold voltage VTHTD (not labeled) of transistor TD is adjustable based on an amount of electrical charges stored in floating gate FG. In some embodiments, to increase the absolute value |VTHTD| of threshold voltage VTHTD, additional charges are injected into floating gate FG. When threshold voltage VTHTD is increased, the absolute value |ITD| of current ITD decreases, which reduces the brightness of OLED L. In some embodiments, transistor TD is a thin film transistor (TFT). Further, because transistor TD has floating gate FG, transistor TD is called a floating gate TFT. In some embodiments, a lower temperature such as 150° C. is used to manufacture TFTs on a glass and/or plastic substrate for a display. Transistor TD is selected as a thin film transistor because thin film transistor TD is able to adapt to the low temperature specification of the glass and/or plastic. Other types of transistors, however, are within the scope of various embodiments. Exemplary transistors include low-temperature polycrystalline silicon (LTPS) transistors, metal oxide transistors, hydrogenated amorphous silicon (a-Si:H) transistors, micro-crystalline silicon transistors, organic transistors etc.

For illustration, voltage VGSTD (not labeled) is a voltage dropped across the gate and the source of transistor TD. In some embodiments, charges in floating gate FG of transistor TD are controlled such that voltage VGSTD is almost a constant value or voltage VGSTD varies within an acceptable range. Because a value of current ITD depends on voltage VGSTD, when voltage VGSTD is constant, current ITD is constant. As a result, the brightness of OLED L is at a stable level.

A signal VDATA is used to change a voltage value of voltage VGSTD to change the brightness of OLED L. For example, when signal VDATA is transferred to the gate of transistor TD, charges are added to floating gate FG. As a result, the absolute value |VTHTD| of threshold voltage VTHTD increases, which causes the absolute value |ITD| of current ITD to decrease and the brightness of OLED L to reduce.

A PMOS transistor TS functions as a switch to pass signal VDATA to transistor TD. A signal SEL at a gate of transistor TS is used to turn on and off transistor TS. A source of transistor TS receives signal VDATA while a drain of transistor TS is coupled with the gate of transistor TD and one end of capacitor CS. In some situations, when electrical charges are injected to transistor TD, signal SEL at the gate of transistor TS is applied with a low logical value to turn on PMOS transistor TS. As a result, signal VDATA at the source of transistor TS is passed to the drain of transistor TS, which is coupled with the gate of transistor TD. Effectively, signal VDATA is passed to the gate of transistor TD to provide charges to floating gate FG of transistor TD. In contrast, when signal SEL is logically high, PMOS transistor TS is turned off, and is electrically disconnected from the gate of transistor TD. As a result, voltage VGSTD remains at the same level supported by capacitor CS.

Capacitor CS is used to stabilize a voltage VGTD (not labeled) at the gate of transistor TD. A first end of capacitor CS is coupled with the gate of transistor TD and a second end is coupled with the source of transistor TD. As a result, voltage VGTD and thus voltage VSGTD and current ITD of transistor TD are stable, keeping the brightness of OLED L at a stable level. The connection of capacitor CS shown in FIG. 2 is for illustration. Other connections to stabilize voltage VGTD at the gate of transistor TD are within the scope of various embodiments. For example, the second end of capacitor CS is configured to receive a stable voltage or ground. Other circuits in place of capacitor CS to stabilize voltage VGTD at the gate of transistor TD are within the scope of various embodiments. In some embodiments, parasitic capacitance at the gate of transistor TD is sufficient to stabilize voltage VGTD. Capacitor CS is therefore not used.

A PMOS transistor TM functions as a switch so that electrical characteristics of transistor TD and OLED L are measured. Depending on application, a source or a drain of transistor TM is coupled with the drain of transistor TD. For example, when a current ITDTM (not labeled) flows from transistor TD through transistor TM, the terminal of transistor TM coupled with the drain of transistor TD is configured as a source of transistor TM. But when a current ITMLED (not labeled) flows from transistor TM through OLED L, the terminal of transistor TM coupled with the drain of transistor TD is configured as the drain of transistor TM. For illustration, the term source/drain and drain/source are used to indicate a terminal of transistor TM is configured as either a source or a drain.

The source/drain of PMOS transistor TM is coupled to the drain of PMOS transistor TD and to the positive node of OLED L while the drain/source of PMOS transistor TM is configured to receive a voltage VMON. When a voltage MONITOR at a gate of transistor TM is logically low, transistor TM is turned on, current ITDTM flows from transistor TD through transistor TM, and is measured based on voltage VMON at the drain/source of transistor TM. Current ITD is calculated from one or a combination of current ITDTM, current ITM, current ITMLED, and voltage VMON. For another example, when transistor TD is off and transistor TM is on, current ITMLED flowing from transistor TM through OLED L is measured to determine an aging or degradation effect of OLED L. Effectively, based on a voltage value of voltage VMON, a degradation effect of OLED L is determined.

In some embodiments, when the brightness difference of any pair of two pixels PIX200 of the display is within an acceptable range, the brightness of the display is considered uniform. In contrast, if the brightness difference of any pair of two pixels is outside the acceptable range, the brightness of the display is non-uniform. In some embodiments, the brightness difference between two pixels PIX200 is reflected on a voltage difference between two voltages VGSTD of two corresponding two transistors TD in two pixels PIX200 and/or a current difference between two currents ITD of two pixels PIX200. In some embodiments, when a value of the current difference between two currents ITD is less 5% of either current value of two currents ITD, the brightness between two pixels is considered uniform. In some embodiments, the brightness uniformity is determined based on a distribution of currents values of currents ITD of all pixels in the display. For example, if a statistical distribution of the current values of all pixels in the display is less than 5%, the brightness of the display is considered uniform. Other values and/or methods to decide the brightness uniformity of two pixels and/or of the display are within the scope of various embodiments.

For illustration, the brightness uniformity of the display is determined based on two neighboring pixels, such as two pixels PIX[i,j] and PIX[i,j+1] in FIG. 1. For illustration, two pixels PIX[i,j] and PIX[i,j+1] in FIG. 1 are implemented as two pixels PIX200 identified as pixels PIX200[*i,j*] and PIX200[*i,j*+1]. Further, the brightness is uniform when the difference between voltage VGSTD[j] of pixel PIX200[*i,j*] and voltage VGSTD[j+1] of PIX200[*i,j*+1] is within an acceptable range, or when the difference between current ITD[i,j] of pixel PIX200[*i,j*] and current ITD[i,j+1] of pixel PIX200[*i,j*+1] is within an acceptable range. In some embodiments, the absolute value |ITD| of current ITD of transistor TD is proportional to the absolute value |VTHTD| of threshold voltage VTHTD of transistor TD. Effectively, in various embodiments, the brightness uniformity is achieved by having the difference between threshold voltage value VTHTD[i,j] of pixel PIX200[*i,j*] and threshold voltage value VTHTD[i,j+1] of pixel PIX200[*i,j*+1] to be within a predetermined and acceptable range. When the difference is close to zero, threshold voltage value VTHTD[i,j] of pixel PIX200 [*i,j*] is substantially close to threshold voltage value VTHTD [i,j+1] of pixel PIX200[*i,j*+1].

Pixel Circuits in Various Further Embodiments

Figure 3:
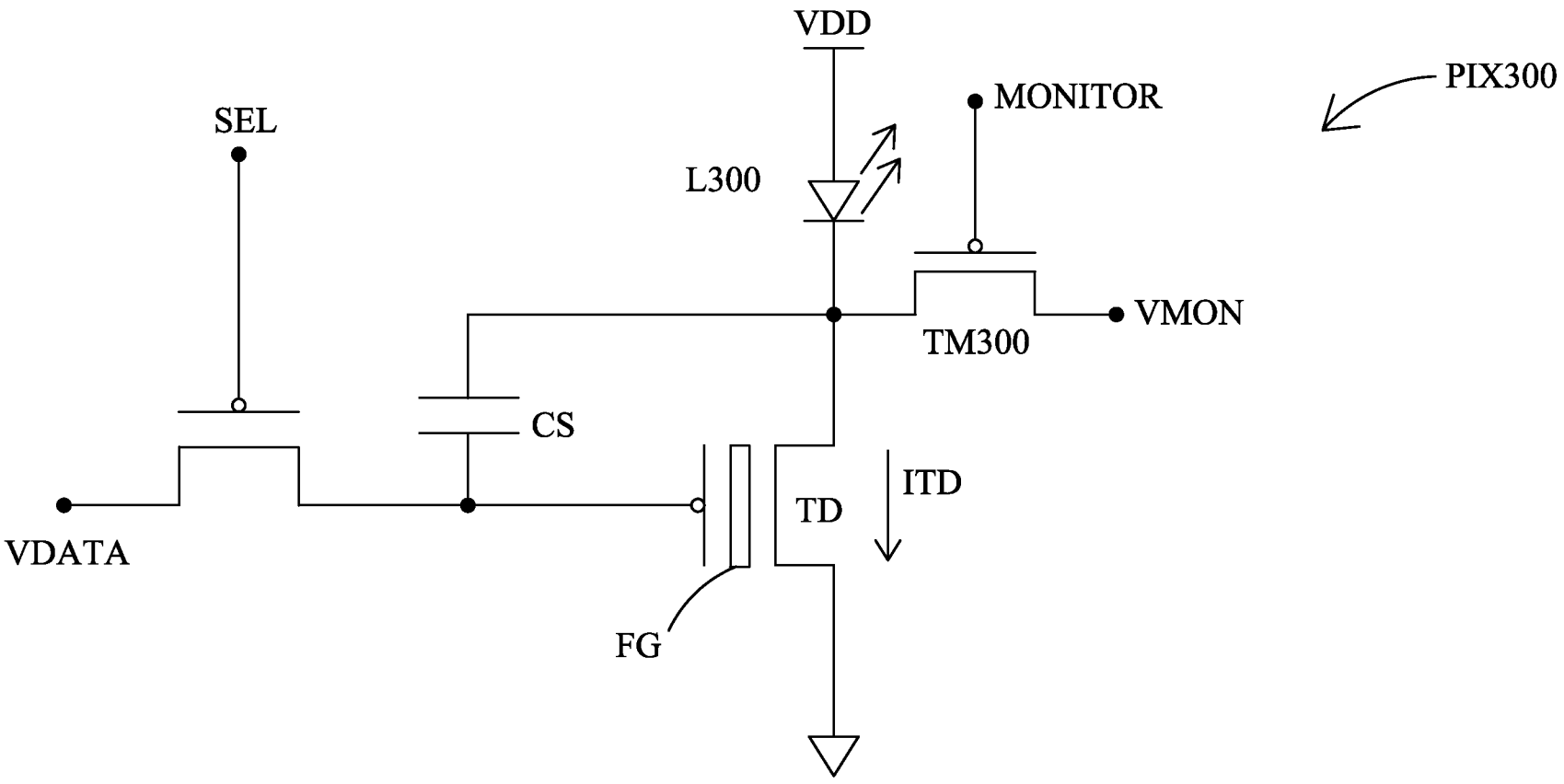
FIGS. 3-5 are diagrams of different pixels in accordance with different embodiments.

FIG. 3 is a diagram of a pixel PIX300, in accordance with some embodiments. Pixel PIX300 is another embodiment of pixel PIX in FIG. 1.

Compared with pixel PIX200 in FIG. 2, an OLED L300 corresponds to OLED L in FIG. 2, and a PMOS transistor TM300 corresponds to PMOS transistor TM in FIG. 2. The location of OLED L300 is different from that of OLED L in pixel PIX200. For example, the positive node of OLED L300 receives operational voltage VDD while the negative node of OLED L300 is coupled to the source of transistor TD. Effectively, OLED serves as a current source for transistor TD and transistor TD serves as a current sink for OLED L300. For example, when both OLED L300 and transistor TD are activated, current ITD flows from operational voltage VDD through OLED L300 and transistor TD to ground. In contrast, in pixel PIX200, transistor TD serves as a current source for OLED L while OLED serves as a current sink for transistor TD.

The location of PMOS transistor TM300 is also different from that of PMOS transistor TM in FIG. 2. For example, a source/drain of PMOS transistor TM300 is coupled to the negative node of OLED L300 and to the source of transistor TD while a drain/source of PMOS transistor TM300 receives voltage VMON.

Operations of pixel PIX300 are similar to operations of pixel PIX200 taking account of different locations of OLED 300 and transistor TM300.

Figure 4:
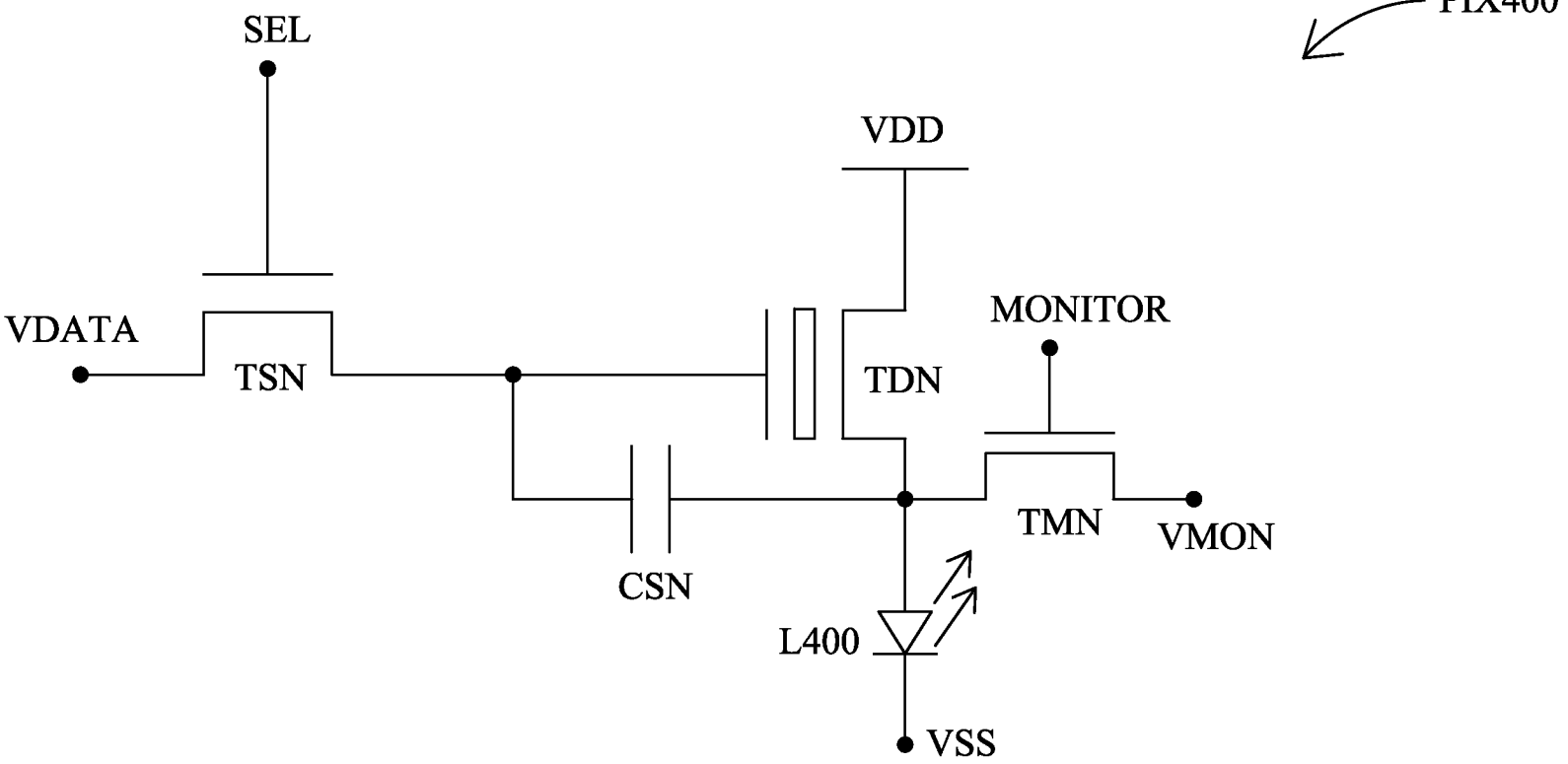

FIG. 4 is a diagram of a pixel PIX400, in accordance with some embodiments. Pixel PIX400 is another embodiment of pixel PIX in FIG. 1.

Compared with pixel PIX200 in FIG. 2, NMOS transistors TSN, TDN, and TMN correspond to PMOS transistors TS, TD, and TM in FIG. 2, respectively. A capacitor CSN corresponds to capacitor CS while an OLED L400 corresponds to OLED Connections of NMOS transistors TSN, TDN, and TMN, capacitor CSN, and OLED L400 are also different. For example, a drain of transistor TSN receives signal VDATA, a source of transistor TSN is coupled with a gate of transistor TDN. A drain of transistor TDN receives operational voltage VDD. A source of transistor TDN is coupled with a positive end of OLED L400 and with a drain/source of transistor TMN. Effectively, transistor TDN serves as a current source for OLED L400 while OLED L400 serves as a current sink for transistor TDN. A source/drain of transistor TMN receives voltage VMON. A first end of capacitor CSN is coupled with the gate of transistor TDN, and a second end of capacitor CSN is coupled with the source of transistor TDN. The connection of capacitor CSN shown in FIG. 4 is for illustration. Other connections are within the scope of various embodiments. For example, the second end of capacitor CSN is instead coupled with another voltage source providing a stabilized voltage, such as operational voltage VDD or reference voltage VSS, etc. Other circuits in place of capacitor CSN used to stabilize a voltage at the gate of transistor TDN are within the scope of various embodiments.

Figure 5:
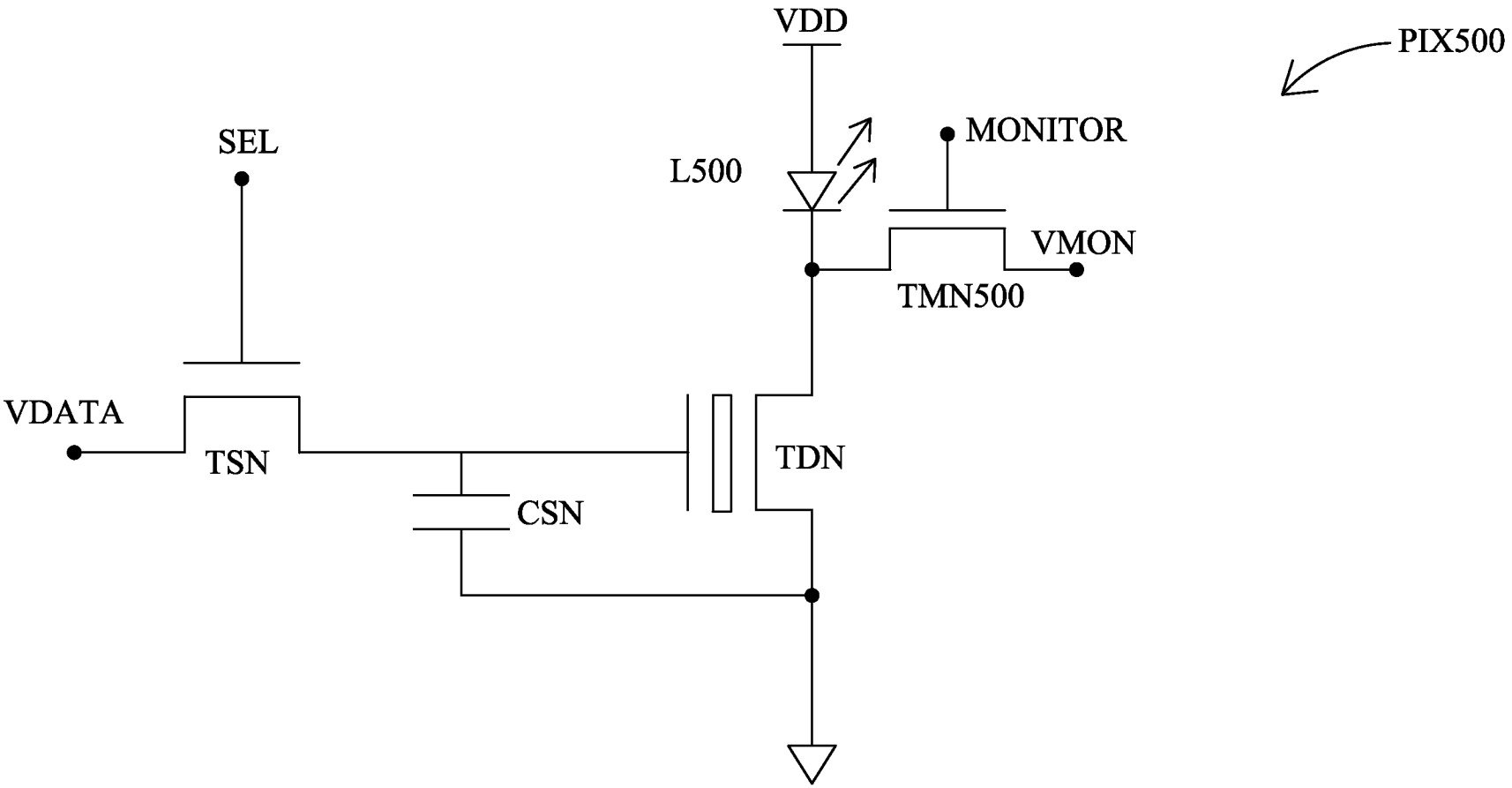

FIG. 5 is a diagram of a pixel PIX500, in accordance with some embodiments. Pixel PIX500 is another embodiment of pixel PIX in FIG. 1.

Compared with pixel PIX400 in FIG. 4, an OLED L500 corresponds to OLED L400 in FIG. 4, and an NMOS transistor TMN500 corresponds to NMOS transistor TMN in FIG. 4. The location of OLED L500 is different from that of OLED L400 in pixel PIX400. For example, the positive node of OLED L500 receives operational voltage VDD while the negative node of OLED L500 is coupled with the drain of transistor TDN. Effectively, OLED L500 serves as a current source for transistor TDN while transistor TDN serves as a current sink for OLED 500. In contrast, in FIG. 4, transistor TDN serves as a current source for OLED L400 while OLED L400 serves as a current sink for transistor TDN.

The location of NMOS transistor TMN500 is also different from that of NMOS transistor TMN in FIG. 4. For example, a drain/source of NMOS transistor TMN500 is coupled with the negative node of OLED L500 and with the drain of transistor TD while a source/drain of NMOS transistor TMN500 receives voltage VMON.

Operations of pixel PIX500 are similar to operations of pixel PIX400 taking account of variations of pixel PIX500 from pixel PIX400.

In the embodiments of FIGS. 4 and 5 that include NMOS transistors TSN, TDN, TMN, and TMN500, the logical value to turn on and off a corresponding transistor is changed accordingly compared with the embodiments of FIGS. 2 and 3 that include PMOS transistors. For example, a PMOS transistor is turned on by a low logical value, and is turned off by a high logical value at the gate of the transistor. In contrast, an NMOS transistor is turned on by a high logical value and is turned off by a low logical value at the gate of the transistor.

Brightness Uniformity Based on I-V Curve Relationships

Figure 6:
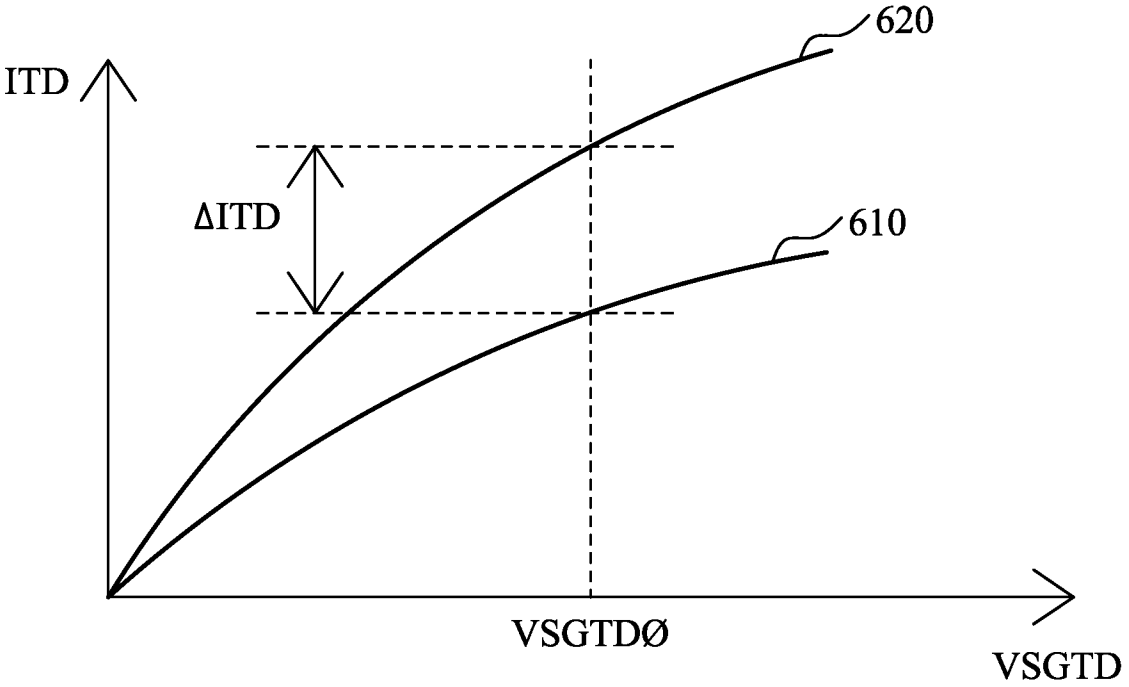
FIG. 6 is a graph of curves illustrating brightness of two pixels based on the current voltage (I-V) relationship of two pixels, in accordance with some embodiments.

FIG. 6 is a graph of curves of the current-voltage (I-V) relationships of two transistors TD in FIG. 2, in accordance with some embodiments. The x-axis indicates voltage VSGTD of transistor TD of a pixel. The y-axis indicates current ITD of transistor TD of the same pixel. A curve 610 represents the relationship between voltage VSGTD[i,j] and current ITD[i,j] of transistor TD of pixel PIX200[*i,j*] while a curve 620 represents the relationship between voltage VSGTD[i,j+1] and current ITD[i,j+1] of transistor TD of pixel PIX200[*i,j*+1]. Curves 610 and 620 are used to illustrate the brightness uniformity between two pixels PIX200[*i,j*] and PIX200[*i,j*+1] based on two currents ITD[i,j] and ITD[i,j+1].

At a particular voltage VSGTD0 on the x-axis, there is a current difference ΔITD between current ITD[i,j] and current ITD[i,j+1]. In some embodiments, voltage VSGTD0 is determined based on a voltage value of signal VDATA, such as half of the voltage value of signal VDATA. For another example, voltage VDD at the source of transistor TD is 20 V. A voltage value of signal VDATA is 15 V. Half of the voltage value of signal VDATA is therefore 7.5 V. As a result, voltage VSGTD0 is 7.5 V-20 V or −12.5 V. Other values for voltage VSGTD0 are within the scope of various embodiments.

In some embodiments, a value of threshold voltage VTHTD[i,j] of pixel PIX200[*i,j*] and/or a value of threshold voltage VTHTD[i,j+1] of pixel PIX200[*i,j*+1] are adjusted such that current difference ΔITD is within a predetermined range. As a result, the brightness difference between two OLEDs L of pixel PIX200[*i,j*] and pixel PIX200[*i,j*+1] are within an acceptable level. In other words, the brightness of pixel PIX200[*i,j*] and of pixel PIX200[*i,j*+1] is uniform. In some embodiments, a pixel PIX200 in a row is selected as a base pixel having a base current. For example, the pixel PIX200 having current ITD with a smallest value among the pixels in a row is selected as the base pixel PIX200. Threshold voltages VTHTD of other pixels PIX200 in the same row are adjusted such that current difference ΔITD between current ITD of the base pixel PIX200 and current ITD of each other pixel PIX200 in a same row are within an acceptable range. As a result, the brightness between the base pixel PIX200 and each of other pixels PIX200 in the same row is uniform.

The brightness uniformity of pixels in another row is achieved in similar manner. In some embodiments, once the brightness uniformity of a line is determined, a value of current ITD in the line is used as the base current value for the next line. For example, a mean value of current ITD or the smallest value of current ITD of the line is used as the base current value. In some other embodiments, a current value selected from the current values in the next line is used as the base current value. In some embodiments, a current value among all current values in the pixel array or the display is used as the base current value. Different ways to determine current difference ΔITD between different pixels in pixel array circuit 100 are within the scope of various embodiments. In other words, different ways to determine the brightness uniformity of pixel array 100 based on currents ITD of two different pixels are within the scope of various embodiments.

Charge Injection to Adjust Threshold Voltage

In some embodiments, threshold voltage VTHTD of transistor TD of pixel PIX200 is adjusted by injecting corresponding charges into floating gate FG of the same transistor TD. In some embodiments, both the drain and the source of transistor TD (as shown in FIG. 2, for example) receive a voltage value of 0 V, and the gate of transistor TD is applied with an electrical pulse. In some embodiments, an amplitude of the pulse is about three times the voltage normally received by the gate of transistor TD. For example, the gate of transistor TD normally receives a voltage of about −20 V. The amplitude of the pulse is therefore about −60 V. A time period of the pulse is about 50 ms. For illustration, the time period is called a stress time, and the amplitude of the pulse is called a stress voltage. In some embodiments, the gate of PMOS transistor TS is applied with a voltage value of −40 V to turn on transistor TS. Signal VDATA at the source of transistor TS is provided with the pulse, which is then transferred to the drain of transistor TS or the gate of transistor TD.

The stress voltage and/or the stress time are selected based on different criteria, such as the time to adjust threshold voltage VTHTD of each particular pixel and of all pixels in pixel array circuit 100, the stress voltage and/or the stress period that can damage transistor TD. For example, when a stress voltage of −40 V, which is about two times voltage VDD, is used, transistor TD is subject to a lesser risk of being damaged, but the time to inject charges to floating gate FG and thus to adjust threshold voltage VTHTD is longer. A stress voltage of about −80 V, which is about 4 times operational voltage VDD, causes irreversible damage to transistor TD, and is therefore not used. In some embodiments, the stress voltage of −40 V and the stress time of 50 mS are used and are achieved through simulation.

For illustration, a conduction current ITDON represents current ITD when transistor TD is completely turned on and operates in a saturation mode, and ITDINJECT represents current ITD when transistor TD is subject to the charge injection. In some embodiments, transistor TD is subject to the charge injection when voltage VDSTD is 0 V. Further, when voltage VDSTD is 0 V, current ITDON is reduced by six orders. Explained in a different way, current ITDON is reduced to current ITDINJECT by six orders of magnitude. Mathematically expressed, ITDINJECT=ITDON*$10^{-6}$ or less when voltage VDSTD is 0 V. In some embodiments, current ITDINJECT is less than 1 nA.

In some embodiment, threshold voltage VTHTD of transistor TD is proportional to the stress time and the absolute value of the stress voltage. For example, the absolute value |VTHTD| of threshold voltage VTHTD increases when the stress time increases and/or the absolute value of the stress voltage increases.

For illustration ΔVTH is a voltage change in threshold voltage VTHTD, |VSTRESS| is the absolute value of the stress voltage, TSTRESS is the stress time, α is the order of VSTRESS, and β is the order of the log function, mathematically, $$\Delta VTH=|VSTRESS|^{\alpha}\log_{\beta}(TSTRESS)$$

In some embodiments, |ΔVTH| is also affected by the number of times a particular stress pulse is applied to the gate of transistor TD. For example, after a stress pulse is selected, such as at −60V and 50 mS, the absolute value |ΔVTHΔ keeps increasing each time the stress pulse is applied again to the gate of transistor TD. After a number of times, such as about 5-10 times, |ΔVTH| no longer changes but stays at a constant value. In other words, continuing to apply the stress pulse to the gate of transistor TD does not cause any additional change in threshold voltage VTHTD of transistor TD. In some embodiments, the number of times the stress pulse is applied to the gate of transistor TD that continues causing a change to threshold voltage VTHTD is achieved through simulations.

Measuring Current ITD

In some embodiments, an over-drive technique is used to measure current ITD in which the measured current is dominated by transistor TD instead of transistor TM because most of the voltage drop from operational voltage VDD is through transistor TD instead of transistor TM. For example, when current ITD is measured, the gate of transistor TS is applied with a voltage value of −40 V to turn on transistor TS. A voltage value of signal VDATA is configured to be closer to threshold voltage VTHTD of transistor TD to ensure that the measured current ITD is not affected by variations of threshold voltage VTHTM of transistor TM. Voltage VDD at the source of transistor TD is set at 0 V, and voltage VSS at one end of OLED L is set at 0 V. Different voltage values are within the scope of various embodiments. For example, both source of transistor TD and one end of OLED are set at a same voltage value. As a result, OLED L is turned off. The gate of transistor TM is also applied with a voltage value of −40 V to turn on transistor TM. Voltage VMON is set at about −13 V so that both transistors TD and TM are turned on while OLED L is turned off. Current ITDTM is measured which, in some embodiments, is current ITD because most of the voltage drops is through transistor TD.

In some embodiments, accuracy of current ITD is affected by the gate voltage of transistor TS. For example, when signal SEL is at −20 V, inaccuracy of current IDT is higher when signal SEL is at −40 V. Simulation is performed to determine a voltage value for signal SEL that results in an acceptable inaccuracy in measuring current ITD.

OLED Degradation

In some embodiments, OLED L is degraded after being used for a time period. The time period and the level of degradation vary depending on a particular OLED and technology. Due to the degradation effect, OLED L takes a larger amount of current to have the same brightness level as before being degraded. In some embodiments, degradation of OLED L is taken into account to determine uniformity of the brightness of pixels in array pixel circuit 100. For example, an amount of additional current to bring OLED L to the brightness level before degradation is determined. Current ITD is increased by the same amount to compensate for the degradation effect. For illustration, the additional current is called the degradation compensation current.

In some embodiments, to measure the degradation compensation current, transistor TD is turned off. For example, the gate of transistor TS (as shown in FIG. 2, for example) is applied with a voltage value of about −40 V to turn on transistor TS. Signal VDATA is set at 10 V, which is transferred to the gate of transistor TD. PMOS transistor TD receiving a voltage value of about 10 V at the gate is therefore turned off. The gate of PMOS transistor TM is applied with a voltage value of about −40 V to turn on transistor TM. A voltage dropped across the drain and the source of transistor TM is set closer to the threshold voltage of OLED L to turn on OLED L. A predetermined value of current ITMLED is supplied to the source/drain of transistor TM and flows through transistor TM and OLED L. The value of current ITMLED varies based on OLED characteristics and technologies. Voltage MON is then measured. In some embodiments, a table is provided to map a value of the measured voltage VMON to a corresponding value of a current in the table. Values for the voltage and current in the table are predetermined for a particular OLED technology and are therefore different based on different technologies. If the values of the measured voltage VMON and of the predetermined current ITMLED match with the corresponding voltage and the current in the table, degradation of OLED has not occurred. But if the values of voltage VMON and of the predetermined current ITMLED do not match the voltage and the current in the table, degradation has occurred. For example, the voltage in the table corresponding to the measured voltage VMON corresponds to a lower current value in the table, degradation of OLED L has occurred. A difference in the predetermined value of current ITMLED and the current in the table is the degradation compensation current. In some embodiments, voltage VSS at one end of OLED L is about −20 V, current ITMLED is about 500 uA, and voltage VMON is about −13 V.

Exemplary Method

Figure 7:
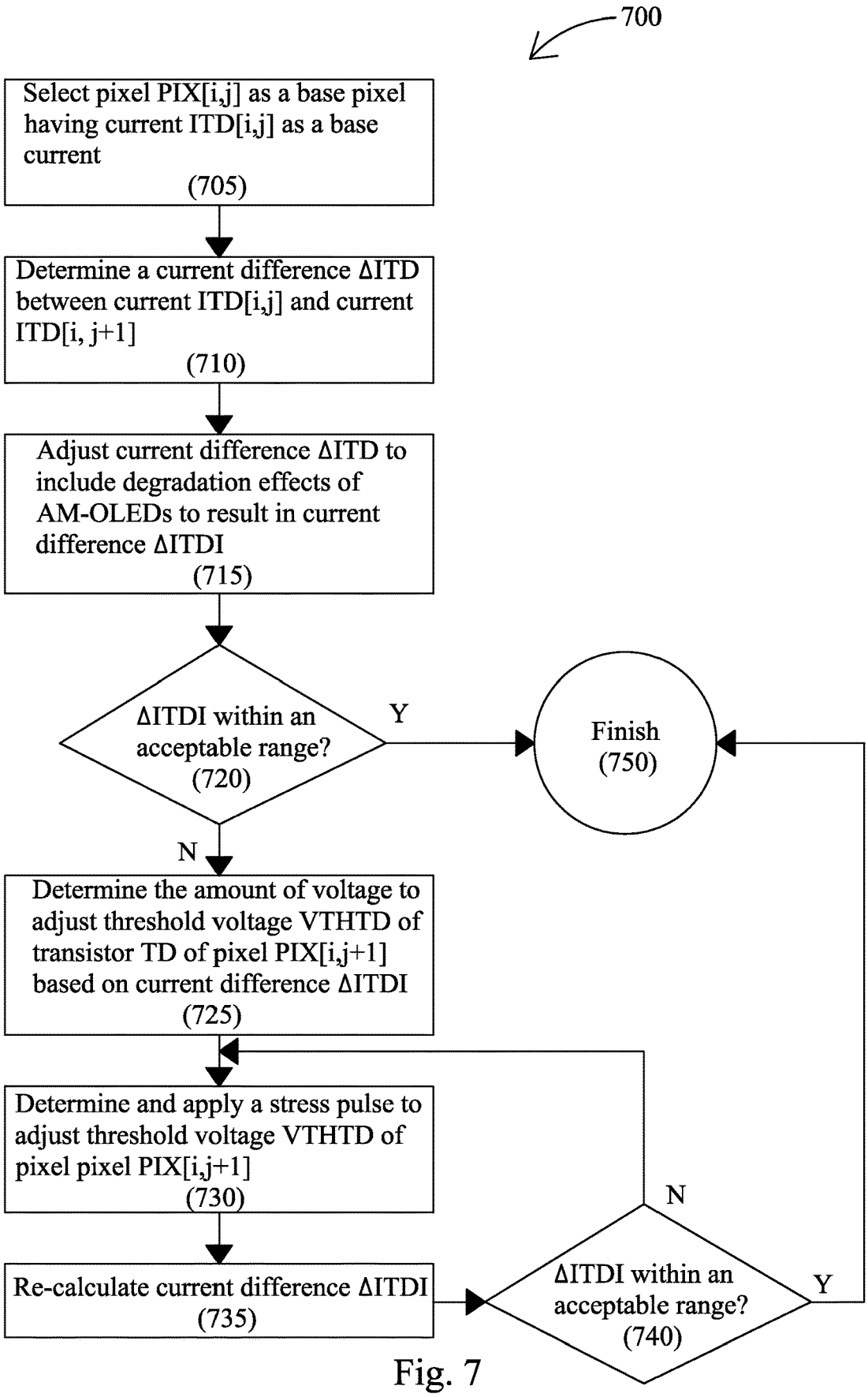
FIG. 7 is a flowchart of a method of increasing brightness uniformity of two pixels, in accordance with some embodiments.

FIG. 7 is flowchart of a method 700 of increasing brightness uniformity between pixel PIX[i,j] and pixel PIX[i,j+1], in accordance with some embodiments.

In operation 705, a pixel PIX is selected as a base pixel having a current ITD as a base current. In some embodiments, a pixel PIX having a smallest value of current ITD in a row of pixels is selected as the base pixel. For illustration, current ITD[i,j] of pixel PIX[i,j] has a smallest current value compared with currents of other pixels in the same row i. Pixel PIX[i,j] is therefore selected as the base pixel.

In operation 710, current difference ΔITD between current ITD[i,j] and current ITD[i,j+1] is determined. For example, current difference ΔITD is determined based on curves 610 and 620 in FIG. 6.

In operation 715, current difference ΔITD is adjusted to include the degradation effect of OLED L in pixel PIX[i,j] and pixel PIX[i,j+1]. For example, the degradation compensation current for each OLED L in pixel PIX[i,j] and pixel PIX[i,j+1] is determined, and is added to current difference ΔITD to result in a current difference ΔITD1.

In operation 720, it is determined whether current difference ΔITD1 is within a predetermined acceptable range. If current difference ΔITD1 is within the predetermined acceptable range, the method ends in operation 750. Because current difference ΔITD1 of transistors TD of pixel PIX[i,j] and pixel PIX[i,j+1] is within the predetermined range, the brightness between pixel PIX[i,j] and pixel PIX[i,j+1] is considered uniform.

If, however, current difference ΔITD1 is not within the predetermined acceptable range, in operation 725, an amount of voltage to adjust threshold voltage VTHTD of transistor TD of pixel PIX[i,j+1] is determined based on current difference ΔITD1. In some embodiments, threshold voltage VTHTD and current ITD is related based on the equation $$ITD=\frac{1}{2}*(W/L)*\mu C_{OX}*(VGSTD-VTHTD)^2$$

where W is a width of transistor TD, L is a length of transistor TD, μ is carrier mobility, $C_{OX}$ is a gate capacitance of transistor TD.

In operation 730, a stress pulse is determined to provide corresponding electrical charges to adjust threshold voltage VTHTD of transistor TD of pixel PIX[i,j+1]. Determining the stress pulse includes determining the stress voltage and the stress time. Once the stress pulse is determined, the stress pulse is applied to the gate of transistor TD of pixel PIX[i,j+1].

In operation 735, current difference ΔITD1 is re-calculated.

In operation 740, it is determined whether current difference ΔITD1 is within the predetermined acceptable range. If it is not, the stress pulse is determined and applied again in operation 730. If, however, current difference ΔITD1 is within the predetermined acceptable range, the method ends in operation 750. In some embodiments, when current difference ΔITD1 is not within the predetermined acceptable range in operation 740, the method returns to operation 725 and proceeds therefrom. For example, in operation 725, an amount of voltage to adjust threshold voltage VTHTD of transistor TD of pixel PIX[i,j+1] is determined based on current difference ΔITD1 re-calculated in operation 735.

In some embodiments, brightness uniformity of each pair of two pixels in a row is determined using method 700. Brightness uniformity between each pair of lines is then determined for the whole display. In some other embodiments, brightness uniformity of each pair of two pixels in the whole display is determined. As a result, brightness uniformity of pixels in the display is achieved. Embodiments of the disclosure are not limited to a particular method.

Pixel PIX[i,j] being used as a base pixel is for illustration. Similarly, current difference ΔITD and/or current difference ΔITD1 between current ITD[i,j] of pixel PIX[i,j] and current [i,j+1] of pixel PIX[i,j+1] is also for illustration. Another pixel is used as a base pixel, and the current difference between the base pixel and another pixel is within the scope of various embodiments.

Pixels PIX and PIX200 used in the above explanation are also for illustration. The inventive concept is applicable to other pixels such as pixel PIX300, pixel PIX400, and pixel PIX500.

A number of embodiments have been described. It will nevertheless be understood that various modifications may be made without departing from the spirit and scope of the disclosure. For example, various transistors being shown as a particular dopant type (e.g., N-type or P-type Metal Oxide Semiconductor (NMOS or PMOS)) are for illustration purposes. Embodiments of the disclosure are not limited to a particular type. Selecting different dopant types for a particular transistor is within the scope of various embodiments. The low or high logical value of various signals used in the above description is also for illustration. Various embodiments are not limited to a particular level when a signal is activated and/or deactivated. Selecting different levels is within the scope of various embodiments. In various embodiments, a transistor functions as a switch. A switching circuit used in place of a transistor is within the scope of various embodiments.

In some embodiments, a method of increasing brightness uniformity between a first pixel and a second pixel in a display is achieved. A current value of the first pixel is determined. A current value of the second pixel is determined. At least one of the current value of the first pixel or the current value of the second pixel is adjusted until a value of a current difference between the current value of the first pixel and the current value of the second pixel is within a predetermined range. The current value of the first pixel corresponds to a brightness level of a light-emitting diode (LED) of the first pixel, and is provided by a transistor of the first pixel. The current value of the second pixel corresponds to a brightness level of an LED of the second pixel, and is provided by a transistor of the second pixel. Adjusting the current value of the first pixel includes adjusting a threshold voltage value of the transistor of the first pixel using a first switch of the first pixel and a second switch of the first pixel. The first switch of the first pixel is electrically coupled with a gate terminal of the transistor of the first pixel, the second switch of the first pixel is electrically coupled with a source terminal of the transistor of the first pixel, and the LED of the first pixel is electrically coupled with the source terminal of the transistor of the first pixel. Adjusting the current value of the second pixel includes adjusting a threshold voltage value of the transistor of the second pixel using a first switch of the second pixel and a second switch of the second pixel. The first switch of the second pixel is electrically coupled with a gate terminal of the transistor of the second pixel, the second switch of the second pixel is electrically coupled with a source terminal of the transistor of the second pixel, and the LED of the second pixel is electrically coupled with the source terminal of the transistor of the second pixel.

In some embodiments, a pixel circuit of display comprises a first transistor, a first switch, and second switch and a light-emitting diode. The first transistor has a first terminal, a second terminal, and a third terminal. A threshold voltage of the first transistor is adjustable. The first terminal of the first transistor is coupled with the first switch. The pixel circuit is configured to meet at least one of the following conditions: a first end of the LED is coupled with the second switch and with the third terminal of the first transistor; or a second end of the LED is coupled with the second switch and with the third terminal of the first transistor. The pixel circuit is configured to meet at least one of a first set of conditions and a second set of conditions. The first set of conditions include: the first transistor is the first PMOS transistor, the first switch includes the second PMOS transistor, and the second switch includes the third PMOS transistor. The gate of the first PMOS transistor is coupled with the second PMOS transistor; and a source of the first PMOS transistor is coupled with a negative terminal of the LED and with the third PMOS transistor. The second set of conditions include: the first transistor is the first NMOS transistor, the first switch includes the second NMOS transistor, and the second switch includes the third NMOS transistor. The gate of the first NMOS transistor is coupled with the second NMOS transistor; and a source of the first NMOS transistor is coupled with a positive terminal of the LED and with the third NMOS transistor.

In some embodiments, a pixel circuit of a display comprises a first transistor, a first switch, a second switch, and a light-emitting diode. The first transistor is configured to provide a current for the LED. A brightness level of the LED is based on a current value of the current provided by the first transistor. The first switch is configured to provide a signal to a floating gate of the first transistor. The signal provided by the first switch is for use in adjusting charges in the floating gate of the first transistor. The second switch is configured as a first current path and/or a second current path. The first current path is configured for use by the current that is provided by the first transistor and that flows through the second switch. The second current path is configured for use by a current that flows through the second switch and the LED. The pixel circuit is configured to meet at least one of a first set of conditions and a second set of conditions. The first set of conditions include: the first transistor is the first PMOS transistor, the first switch includes the second PMOS transistor, and the second switch includes the third PMOS transistor; the gate of the first PMOS transistor is coupled with the second PMOS transistor; and a source of the first PMOS transistor is coupled with a negative terminal of the LED, and the third PMOS transistor. The second set of conditions include: the first transistor is the first NMOS transistor, the first switch includes the second NMOS transistor, and the second switch includes the third NMOS transistor; the gate of the first NMOS transistor is coupled with the second NMOS transistor; and a source of the first NMOS transistor is coupled with a positive terminal of the LED, and the third NMOS transistor.

Various figures showing capacitors are for illustration. Equivalent circuitries are within the scope of various embodiments. For example, a capacitive device, circuitry or network, such as a combination of capacitors, capacitive devices, circuitry, etc., can be used in place of a capacitor.

The above illustrations include exemplary steps, but the steps are not necessarily performed in the order shown. Steps may be added, replaced, changed order, and/or eliminated as appropriate, in accordance with the spirit and scope of disclosed embodiments.

What is claimed is:

1. A method of increasing brightness uniformity between a first pixel and a second pixel in a display, the method comprising:

determining a current value of the first pixel;

determining a current value of the second pixel;

adjusting at least one of the current value of the first pixel or the current value of the second pixel until a value of a current difference between the current value of the first pixel and the current value of the second pixel is within a predetermined range;

wherein:

the current value of the first pixel corresponds to a brightness level of a light-emitting diode (LED) of the first pixel, and is provided by a transistor of the first pixel;

the current value of the second pixel corresponds to a brightness level of an LED of the second pixel, and is provided by a transistor of the second pixel;

the adjusting the current value of the first pixel includes:

adjusting a threshold voltage value of the transistor of the first pixel using a first switch of the first pixel and a second switch of the first pixel, the first switch of the first pixel is electrically coupled with a gate terminal of the transistor of the first pixel, the second switch of the first pixel is electrically coupled with a source terminal of the transistor of the first pixel, and an anode of the LED of the first pixel is electrically coupled with the source terminal of the transistor of the first pixel, wherein, relative to a cathode of the LED of the first pixel, the anode of the LED of the first pixel is more proximate the source terminal of the transistor of the first pixel;

the adjusting the current value of the second pixel includes:

adjusting a threshold voltage value of the transistor of the second pixel, using a first switch of the second pixel and a second switch of the second pixel, according to a nonlinear expression which includes a first term representing a voltage drop across gate and source terminals of the transistor of the second pixel and a second term representing a threshold voltage of the transistor of the second pixel, the first switch of the second pixel is electrically coupled with a gate terminal of the transistor of the second pixel, the second switch of the second pixel is electrically coupled with a source terminal of the transistor of the second pixel, and the LED of the second pixel is electrically coupled with the source terminal of the transistor of the second pixel; and the method further comprises:

applying a first voltage to the source terminal of the transistor of the first pixel through the second switch of the first pixel; and wherein:

the transistor of the first pixel is an NMOS transistor; and at least one of the following circumstances is true:

a first circumstance in which:

the transistor of the first pixel has a floating gate storing electrical charges that affect the threshold voltage value of the transistor of the first pixel; and the adjusting the threshold voltage value of the transistor of the first pixel includes:

adjusting electrical charges in the floating gate of the transistor of the first pixel; or a second circumstance in which:

the transistor of the second pixel has a floating gate storing electrical charges that affect the threshold voltage value of the transistor of the second pixel; and the adjusting the threshold voltage value of the transistor of the second pixel includes:

adjusting electrical charges in the floating gate of the transistor of second first pixel.

2. The method of claim 1, further comprising at least one of the following conditions:

adjusting the current value of the first pixel further includes applying a second voltage to the gate terminal of the transistor of the first pixel for a first time period while applying a third voltage value to the source terminal of the transistor of the first pixel and a fourth voltage value to a drain terminal of the transistor of the first pixel; or adjusting the current value of the second pixel further includes applying a fifth voltage to the gate terminal of the transistor of the second pixel for a second time period while applying a sixth voltage value to the source terminal of the transistor of the second pixel and a seventh voltage value to a drain terminal of the transistor of the second pixel.

3. The method of claim 1, further comprising at least one of the following scenarios:

a first scenario including:

applying a second voltage to the gate terminal of the transistor of the first pixel through the first switch of the first pixel; and applying a fifth voltage to the source terminal of the transistor of the first pixel through the second switch of the second pixel; or a second scenario including:

applying a third voltage to the gate terminal of the transistor of the second pixel through the first switch of the second pixel; and applying a fourth voltage to the source terminal of the transistor of the second pixel through the second switch of the second pixel.

4. The method of claim 1, further comprising at least one the following conditions:

adjusting the current value of the first pixel comprises compensating for degradation of the LED of the first pixel; or adjusting the current value of the second pixel comprises compensating for degradation of the LED of the second pixel.

5. The method of claim 4, further comprising at least one of the following conditions:

the transistor of the first pixel is turned off based on a second voltage applied through the first switch of the first pixel to the gate terminal of the transistor of the first pixel;

a third voltage at a terminal of the second switch of the first pixel is determined based on a current flowing through the second switch of the first pixel and the LED of the first pixel;

the transistor of the second pixel is turned off based on a fourth voltage applied through the first switch of the second pixel to the gate terminal of the transistor of the second pixel; or a fifth voltage at a terminal of the second switch of the second pixel is determined based on a current flowing through the second switch of the second pixel and the LED of the second pixel.

6. The method of claim 1, wherein:

the adjusting a threshold voltage value of the transistor of the second pixel is based on an equation as follows:

$$ITD=\frac{1}{2}*(W/L)*\mu*Cox*(VGSTD-VTHTD)^2$$

and wherein:

ITD is the current value of the first pixel;

W is a width of the transistor of the second pixel;

L is a length of the transistor of the second pixel;

μ is a carrier mobility;

Cox is a gate capacitance of the transistor of the second pixel;

VGSTD is the voltage drop across gate and source terminals of the transistor of the second pixel; and VTHTD is the threshold voltage of the transistor of the second pixel.

7. The method of claim 1, wherein:

the first and second pixels are included in an array of pixels in the display; and the method further comprises:

determining a level of brightness uniformity of each row or each column in the array on a corresponding row-by-row basis or column-by-column basis.

8. A pixel circuit of a display comprising:

a first transistor having a first terminal, a second terminal, and a third terminal, the first transistor being configured to include a floating gate;

a first switch;

a second switch; and a light-emitting diode (LED); and wherein:

a threshold voltage of the first transistor is adjustable;

the first terminal of the first transistor is coupled with the first switch; and the pixel circuit is configured to meet at least one of the following conditions:

a first end of the LED is coupled with the second switch and with the third terminal of the first transistor; or a second end of the LED is coupled with the second switch and with the third terminal of the first transistor; and the pixel circuit is configured to meet at least one of a first set of conditions or a second set of conditions;

the first set of conditions include:

the first transistor is a first PMOS transistor, the first switch includes a second PMOS transistor, and the second switch includes a third PMOS transistor;

the first terminal of the first PMOS transistor is coupled with the second PMOS transistor; and the third terminal of the first PMOS transistor is a source terminal and is coupled with a cathode of the LED and with the third PMOS transistor, wherein, relative to an anode of the LED, the cathode of the LED is more proximate the source terminal of the first PMOS transistor; and the second set of conditions include:

the first transistor is a first NMOS transistor, the first switch includes a second NMOS transistor, and the second switch includes a third NMOS transistor;

the first terminal of the first NMOS transistor is coupled with the second NMOS transistor; and a source terminal of the first NMOS transistor is coupled with the anode of the LED and with the third NMOS transistor.

9. The pixel circuit of claim 8, wherein the first transistor is selected from a group consisting of a thin film transistor, a low temperature polycrystalline silicon transistor, a metal oxide transistor, a hydrogenated amorphous silicon (a-Si:H) transistor, a microcrystalline silicon transistor, or an organic transistor.

10. The pixel circuit of claim 8, further comprising a stabilization circuit coupled with the first terminal of the first transistor and configured to stabilize a voltage at the first terminal of the first transistor.

11. The pixel circuit of claim 10, wherein the stabilization circuit includes a capacitive device;

a first end of the capacitive device is coupled with the first terminal of the first transistor; and a second end of the capacitive device is coupled with the third terminal of the first transistor.

12. The pixel circuit of claim 8, wherein the second switch is configured as a current path for a current that is generated from the first transistor and that flows through the second switch; and the threshold voltage of the first transistor is adjusted based on the current.

13. The pixel circuit of claim 8, wherein the second switch is configured as a current path for a current to flow through the second switch and the LED.

14. The pixel circuit of claim 8, wherein the LED is an organic LED or an active matrix organic LED.

15. The pixel circuit of claim 8, further comprising:

a capacitor having first and second terminals; and wherein:

under the first set of conditions:

the first terminal of the capacitor is coupled to the first terminal of the first PMOS transistor and the second PMOS transistor; and the second terminal of the capacitor is coupled to the source terminal of the first PMOS transistor, the cathode of the LED and the third PMOS transistor; or under the second set of conditions:

the first terminal of the capacitor is coupled to the first terminal of the first NMOS transistor and the second NMOS transistor; and the second terminal of the capacitor is coupled to the source terminal of the first NMOS transistor, the anode of the LED and the third NMOS transistor.

16. A pixel circuit of a display comprising:

a first transistor having a first terminal, a second terminal, and a third terminal, the first transistor being configured to include a floating gate;

a first switch;

a second switch; and a light-emitting diode (LED);

a stabilization circuit coupled with the first terminal of the first transistor and configured to stabilize a voltage at the first terminal of the first transistor, the stabilization circuit including a capacitive device, a first end of the capacitive device is coupled with the first terminal of the first transistor, and a second end of the capacitive device is coupled with the third terminal of the first transistor; and wherein:

a threshold voltage of the first transistor is adjustable;

the first terminal of the first transistor is coupled with the first switch; and the pixel circuit is configured to meet at least one of the following conditions:

a first end of the LED is coupled with the second switch and with the third terminal of the first transistor; or a second end of the LED is coupled with the second switch and with the third terminal of the first transistor; and the pixel circuit is configured to meet at least one of a first set of conditions or a second set of conditions;

the first set of conditions include:

the first transistor is a first PMOS transistor, the first switch includes a second PMOS transistor, and the second switch includes a third PMOS transistor;

the first terminal of the first PMOS transistor is coupled with the second PMOS transistor; and the third terminal of the first PMOS transistor is a source terminal and is coupled with a cathode of the LED and with the third PMOS transistor, wherein, relative to an anode of the LED, the cathode of the LED is more proximate the source terminal of the first PMOS transistor; and the second set of conditions include:

the first transistor is a first NMOS transistor, the first switch includes a second NMOS transistor, and the second switch includes a third NMOS transistor;

the first terminal of the first NMOS transistor is coupled with the second NMOS transistor; and a source terminal of the first NMOS transistor is coupled with the anode of the LED and with the third NMOS transistor.

17. The pixel circuit of claim 16, wherein the first transistor is selected from a group consisting of a thin film transistor, a low temperature polycrystalline silicon transistor, a metal oxide transistor, a hydrogenated amorphous silicon (a-Si:H) transistor, a microcrystalline silicon transistor, or an organic transistor.

18. The pixel circuit of claim 16, wherein the second switch is configured as a current path for a current that is generated from the first transistor and that flows through the second switch; and the threshold voltage of the first transistor is adjusted based on the current.

19. The pixel circuit of claim 16, wherein the second switch is configured as a current path for a current to flow through the second switch and the LED.

20. The pixel circuit of claim 16, wherein the LED is an organic LED or an active matrix organic LED.

* * * * *